US007556034B2

(12) United States Patent
De Miranda Grieco

(10) Patent No.: US 7,556,034 B2
(45) Date of Patent: Jul. 7, 2009

(54) SELF-CLEANING KITCHEN-RANGE AND ASSEMBLY COUPLABLE TO A SURFACE

(76) Inventor: Antonio Augusto De Miranda Grieco, Rua dos Franceses, 174/161 B, Bela Vista, 01329-010, São Paulo-SP (BR)

( * ) Notice: Subject to any disclaimer, the term of this patent is extended or adjusted under 35 U.S.C. 154(b) by 132 days.

(21) Appl. No.: 11/450,253

(22) Filed: Jun. 9, 2006

(65) Prior Publication Data

US 2007/0044789 A1 Mar. 1, 2007

Related U.S. Application Data

(63) Continuation-in-part of application No. 10/551,617, filed as application No. PCT/BR2004/000049 on Apr. 1, 2004.

(30) Foreign Application Priority Data

Apr. 3, 2003 (BR) ..... 0300856
Oct. 6, 2005 (BR) ..... 0304574

(51) Int. Cl.
*F24C 15/10* (2006.01)
*B08B 3/00* (2006.01)

(52) U.S. Cl. ..... 126/211; 126/299 E; 134/115 G

(58) Field of Classification Search ..... 126/299 E, 126/211, 273 R, 214 R, 214 A; 239/251
See application file for complete search history.

(56) References Cited

U.S. PATENT DOCUMENTS

| | | | | |
|---|---|---|---|---|
| 3,059,632 | A * | 10/1962 | Rogers | 126/37 R |
| 3,149,624 | A * | 9/1964 | Reeves | 126/37 R |
| 3,373,754 | A * | 3/1968 | Squire | 134/58 D |
| 3,951,684 | A * | 4/1976 | LaPrad et al. | 134/144 |
| 3,986,891 | A * | 10/1976 | Rumbaugh | 134/58 D |
| 5,685,028 | A * | 11/1997 | Miller et al. | 4/443 |
| 6,381,774 | B1 * | 5/2002 | Wales | 4/678 |
| 6,405,738 | B1 * | 6/2002 | Clark et al. | 134/115 R |
| 6,532,972 | B2 * | 3/2003 | Tarala | 134/22.18 |
| 6,895,957 | B2 * | 5/2005 | Yeung | 126/299 E |
| 6,997,196 | B2 * | 2/2006 | Eiermann | 134/105 |
| 2005/0023379 | A1 * | 2/2005 | Lau | 239/526 |

FOREIGN PATENT DOCUMENTS

FR 2208626 * 6/1974

* cited by examiner

*Primary Examiner*—Kenneth B Rinehart
*Assistant Examiner*—Chuka C Ndubizu
(74) *Attorney, Agent, or Firm*—TraskBritt

(57) ABSTRACT

The present invention relates to a kitchen-range comprising a self-cleaning assembly that enables one to clean concomitantly the cooking top of the kitchen range and any other contiguous surface that is integrated therewith or located close to said cooking top. The invention further deals with a self-cleaning assembly that can be coupled to numberless surfaces, so as to enable them to benefit from a cleaning process of spraying cleaning elements such as liquids, vapors, supercritical fluids, etc.

24 Claims, 5 Drawing Sheets

SELF-CLEANING KITCHEN-RANGE AND ASSEMBLY COUPLABLE TO A SURFACE

CROSS-REFERENCE TO RELATED APPLICATIONS

This application is a continuation-in-part of U.S. patent application Ser. No. 10/551,617, filed Jan. 26, 2007 and entitled "A KITCHEN-RANGE, AN OVEN AND A SELF-CLEANING ASSEMBLY," currently pending, which is a national-stage entry of PCT International Application No. PCT/BR2004/000049, filed Apr. 1, 2004, designating the United States of America, and published, in English, as PCT International Publication No. WO2004/088208 on Oct. 14, 2004, which itself claims the benefit of Brazilian Patent Application PI0300856-8, filed Apr. 3, 2003, and Brazilian Patent Application PI0304574-9, filed Oct. 6, 2003. This application also claims the benefit of Brazilian Certificate of Addition of Invention C10304574-9, filed Jun. 10, 2005. The disclosures of the entirety of each of which are incorporated herein by this reference.

BACKGROUND OF THE INVENTION

1. Field of the Invention

The invention relates to a self-cleaning assembly that can be coupled, mounted or fixed to continuous surfaces, particularly to kitchen-range tops. The self-cleaning assembly of the present invention can be equally manufactured as an integral part of kitchen-ranges or cooking tops or any other continuous surfaces, such as workbenches, sinks, etc. The present invention further foresees the possibility of the kitchen-range self-cleaning assembly being integrated with a dish-washing machine.

2. State of the Art

Cleaning assemblies and/or systems for different household apparatus are known from the prior art, which comprise spraying cleaning fluids such as liquids, steams and supercritical fluids.

The self-cleaning systems existing at present do not enable one to clean concomitantly a kitchen-range cooking top and a tray surface that is integrated with the kitchen-range. At present, only the cooking top can be automatically cleaned. The workbench or any other surface integrated with the cooking top has to be manually cleaned by the user.

This is little practical and toilsome, making clear the need to develop a novel cleaning system that will enable one to clean and sanitize concomitantly integrated surfaces such as cooking tops, sinks, workbenches, etc.

SUMMARY OF THE INVENTION

A first objective of the present invention is to provide a kitchen-range with a self-cleaning assembly that comprises a work area close to the cooking top, that is to say, an extension of the cooking top intended for the preparation of food and which can also receive the benefits provided by the self-cleaning system of the kitchen-range. For the purposes of the present invention, the kitchen-range cooking top having this work area will be defined hereinafter as an extended top.

A second objective of the present invention is to provide a kitchen-range with a self-cleaning assembly for the cooking top integrated with the kitchen sink, counter, top, cabinet top surface, workbench and even supporting surface for the preparation of grilled food such as barbecue, so that the actuation of the self-cleaning assembly will embrace the other cited surfaces too. It should be understood that, just as the kitchen-range cooking top with a work area, the surfaces cited in this paragraph will also be mentioned hereinafter as an extended top of contiguous/integrated surfaces.

A third objective of the present invention is to provide a self-cleaning assembly for a kitchen-range that has at least one retractable spraying means (defined as a retractable cleaning tower/retractable spraying tower), which is accommodated close to the surfaces of the cooking top and other integrated surfaces.

A fourth objective of the present invention is to provide a kitchen-range with a self-cleaning assembly for the cooking top, integrated with a dish-washing machine.

A fifth objective of the present invention is to provide a kitchen-range with a self-cleaning assembly for the cooking top, integrated with an oven with a self-cleaning assembly for the oven.

A sixth objective of this invention is to provide a self-cleaning assembly capable of performing alternating cleaning cycles with vapor spraying, negative-pressure suction, application of ultrasound and application of pressurized gases.

A seventh objective of the present invention is to provide, among the cleaning elements for the kitchen-range surfaces and contiguous surfaces, the supercritical fluids.

An eighth objective of the present invention is to provide a kitchen-range with a self-cleaning assembly for the cooking top, which will also function as an environment deodorizer.

The present invention achieves these and other objectives by means of a kitchen-range of the type that has a cooking top comprising a surface on which at least one heating device is arranged and on which a support means is arranged, the kitchen-range comprising a first cleaning-element spraying assembly comprising at least one retractable spraying tower arranged close to the cooking-top surface, the retractable spraying tower comprising a piston having orifices, said cooking-top surface having an opening that allows said piston to move upwards to a raised position with respect to the surface and downwards to a position leveled with the surface, said surface being inclined with respect to the horizontal plane, so that the elements sprayed by the retractable spraying tower can flow into an outflow opening connected to a circuit that feeds cleaning elements back to said spraying assembly; a cleaning-element supplying valve connecting a source to said circuit, and a cleaning-element draining valve connecting the circuit to an external draining means; and control means for opening and closing the valves, permitting the entry and exit of the cleaning element into and out of the circuit, and for turning on and off said valves, initiating and finishing the circulation of the cleaning elements in the circuit.

The invention further foresees a self-cleaning assembly couplable to a surface of the kitchen-range cooking top, which comprises at least a first conduit liable to connect an outflow opening in said cooking-top surface to propulsion means, and at least one second conduit liable to connect the propulsion means to a cleaning-element spraying assembly, which comprises at least one retractable spraying tower on said surface, so that the opening, the first conduit, the propulsion means, the second conduit, the spraying assembly comprising at least one retractable spraying tower will form a cleaning circuit; a cleaning-element supplying valve connecting an external source to said circuit, and a cleaning-liquid draining valve connecting the circuit to an external draining means.

Additionally, the invention provides a self-cleaning assembly couplable to a surface of an extended top, comprising at least one first conduit liable to connect an outflow opening in said extended-top surface to propulsion means, and at least one second conduit liable to connect the propulsion means to a cleaning-element spraying assembly comprising at least one retractable spraying tower on said surface, so that the opening, the first conduit, the propulsion means, the second conduit, the spraying assembly comprising at least one retractable spraying tower will form a cleaning circuit; a cleaning-element supplying valve connecting an external source to said circuit, and a cleaning-liquid draining valve connecting the circuit to an external draining means.

One also foresees a kitchen-range of the type that has a cooking top comprising a surface on which at least one heating device is arranged and on which at least one support means is arranged; the kitchen-range comprising a first cleaning-element spraying assembly comprising at least one retractable spraying tower arranged close to the cooking top surface, the retractable spraying tower comprising a piston having orifices, said cooking-top surface having an opening that allows said pistons to move upwards to a raised position with respect to the surface and downwards to a position leveled with the surface, said surface being slightly inclined downwards with respect to the horizontal plane in the direction of the opening, so that elements sprayed by the retractable spraying tower will flow through the opening, which is connected to a cleaning-element reservoir; a cleaning-element propulsion means connected to said reservoir and to said retractable spraying tower, so that said opening, the retractable spraying tower, the reservoir and the cleaning-element spraying means will form a cleaning circuit; and control means for turning on and off the functioning of the propulsion means, enabling the circulation of cleaning elements through the circuit.

The invention further relates to an extended top comprising a work area and an embedded cooking top, said cooking top comprising a surface on which at least one heating device is arranged and on which a support means is arranged; it further comprises a cleaning-element spraying assembly comprising at least one retractable spraying tower arranged close to the surface of the cooking top, the retractable spraying tower comprising a piston including orifices, said cooking-top surface having an opening that allows said piston to move upwards to a raised position with respect to the surface and downwards to a position leveled with the surface, said surface being inclined with respect to the horizontal plane, so that the elements sprayed by the retractable spraying tower can flow into the outflow opening connected to a circuit that feeds cleaning elements back to said spraying assembly; a cleaning-element supplying valve connecting an external source to said circuit, and a cleaning-element draining valve connecting the circuit to an external draining means; and control means for opening and closing the valves, permitting the entry and exit of the cleaning elements into and out of the circuit, and for turning on and off said valves, thus initiating and finishing the circulation of cleaning elements through the circuit.

The invention further relates to a kitchen-range of the type that has a cooking top comprising a surface on which at least one heating device is arranged and on which a support means is arranged; it further comprises a cleaning-element spraying assembly comprising at least one retractable spraying tower arranged close to the surface of the cooking top, the retractable spraying tower comprising a piston including orifices, said cooking-top surface having an opening that allows said piston to move upwards to a raised position with respect to the surface and downwards to a position leveled with the surface, said surface being inclined with respect to the horizontal plane, so that the elements sprayed by the retractable spraying tower can flow into the outflow opening connected to a circuit that feeds cleaning elements back to said spraying assembly; said re-feeding circuit making part of a hydraulic system of a dish-washing machine comprising a tubing connected to the water-supply network and another tubing connected to a sewage network.

BRIEF DESCRIPTION OF THE DRAWINGS

The present invention will now be described in greater detail on the basis of embodiments represented in the figures.

DETAILED DESCRIPTION OF THE ILLUSTRATED EMBODIMENTS

Figure 1:
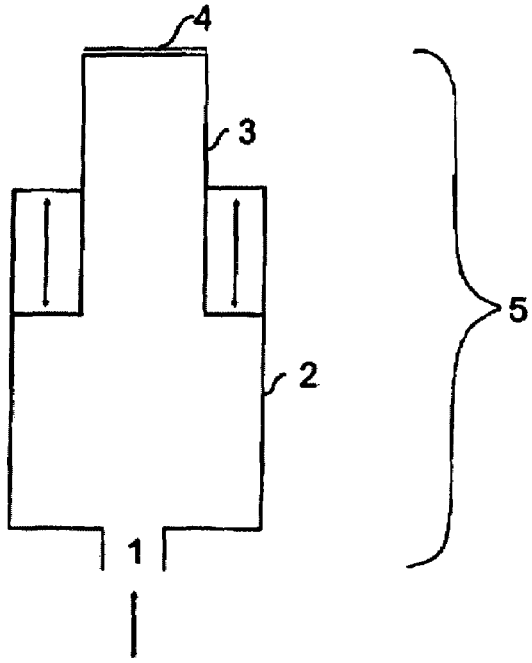
FIG. 1 illustrates a sectional view of an embodiment of the retractable spraying tower.

FIG. 1 shows a preferred embodiment of the retractable spraying tower of the present invention, including a cleaning-element inlet 1, an external envelope 2 and an internal "piston" 3. The piston 3 is capable of moving upwards and downwards, driven by the force of the water or by the force of any other cleaning element that can be sprayed by the retractable tower 5.

Figure 1A:
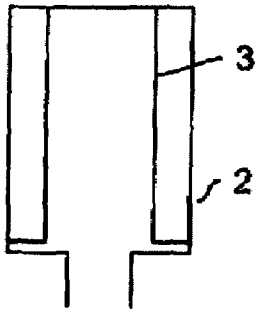
FIG. 1A illustrates a sectional view of the spraying tower in a retracted position, that is to say, in a position in which the piston of the spraying tower is at the same level as the surface of a cooking top or of an extended top.
Figure 1B:
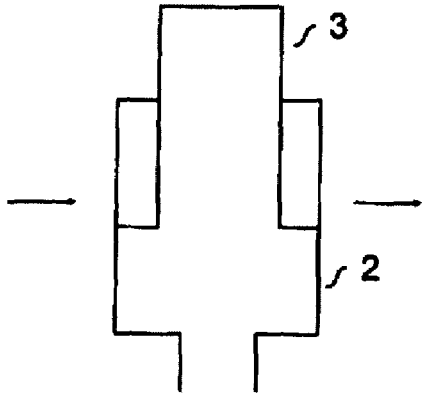
FIG. 1B illustrates a sectional view of the spraying tower in a raised position with respect to the surface of a cooking top or to the surface of an extended top, showing the movement upwards which the piston is capable of doing in order to spray the cleaning elements over the surfaces.
Figure 1C:
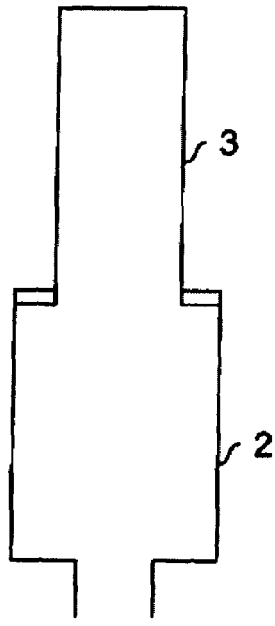
FIG. 1C illustrates a sectional view of the spraying tower totally raised with respect to the surface of a cooking top or to the surface of an extended top, this being the preferred position for spraying cleaning elements.

FIG. 1A shows the spraying tower 5 in an initial position, empty. In FIG. 1B, the tower is illustrated partly filled with fluid, which causes the piston 3 to rise. FIG. 1C shows the spraying tower totally filled, so that the piston 3 is in a raised position. The jets of fluid are directed so as to sweep the surfaces to be cleaned (cooking top, heating elements, support means, cover and all the components potentially liable to receive the cleaning fluids jetted by the spraying tower). In order for the jets to be jetted/sprayed onto these surfaces and other elements that compose the cooking top, there may be orifices, slots or opening in the internal piston 3, so as to enable the fluid to come out sprayed in the desired directions through the tower 5.

The shape and number of orifices, slots or openings may vary as necessary to reach the most varied shapes and sizes of cooking tops, extended cooking tops or those integrated with counters and sinks.

The fluid flow in the piston outlets may cause its rotation or oscillation movement, in addition to the rising and falling movements. Alternative embodiments of the fluid inlet in the cleaning tower, number of towers, positions of towers, as well as different pistons, constituted by more than one piece, each with its own movement and being independent, are admitted herein without departing from the scope of the present invention.

A finish 4 is liable to be adapted or incorporated into the top of the spraying tower for esthetic purpose. This finish 4 may further have orifices for the cleaning fluids to pass through it or even take other spraying directions while passing through it. It is important to point out that the purpose of the cleaning tower is to jet fluids over the parts to be cleaned and to be retractable, and for this purpose it may assume various shapes with a different number of parts, using different materials such as, for example, metals, polymers, glass, and ceramic.

There is still the possibility of providing flaps, screws, gears and other constructions on the tower, in order to bring about the rotation movement of the piece by water passing through it. It is important to understand that the figures shown herein are simplified, and the retractable spraying tower 5 may have thereon several pieces such as, for example, springs, spheres, mountings, filters, screws, not shown herein.

Figure 2:
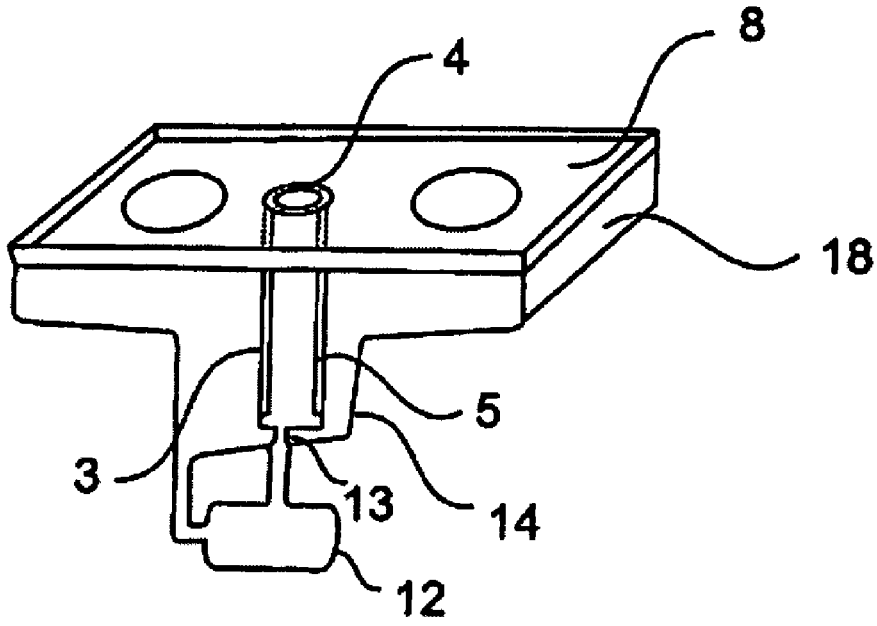
FIG. 2 illustrates a sectional view of the kitchen-range cooking top with the spraying tower and the self-cleaning assembly.

FIG. 2 shows the spraying tower 5 in its housing, embedded in a cooking top 8 of a kitchen-range 18, with the piston 3 located inside its outer envelope 2. The surface of the cooking top 8 comprises an opening that permits upward and downward movement of the spraying tower 5. FIG. 2 figure shows the finish 4 of the spraying tower 5, filling this opening at the moment when the tower is in its retracted position, that is to say, when the finish 4 (or the top surface) of the tower is at the same level as the surface of the cooking top 8.

As can be seen in FIG. 2 as well, the tower is within a reservoir 14, incorporated into the cooking top 8 of the kitchen-range 18, in which the cleaning elements to be propelled and then sprayed by the spraying tower 5 are housed. FIG. 2 further illustrates the connection 13 between the propelling pump 12 and the fluid inlet 1 of the spraying tower 5. In this embodiment, one can arrange a cleaning-fluid heating element (such as valves or controls not shown in this figure) inside the reservoir 14.

Figure 3:
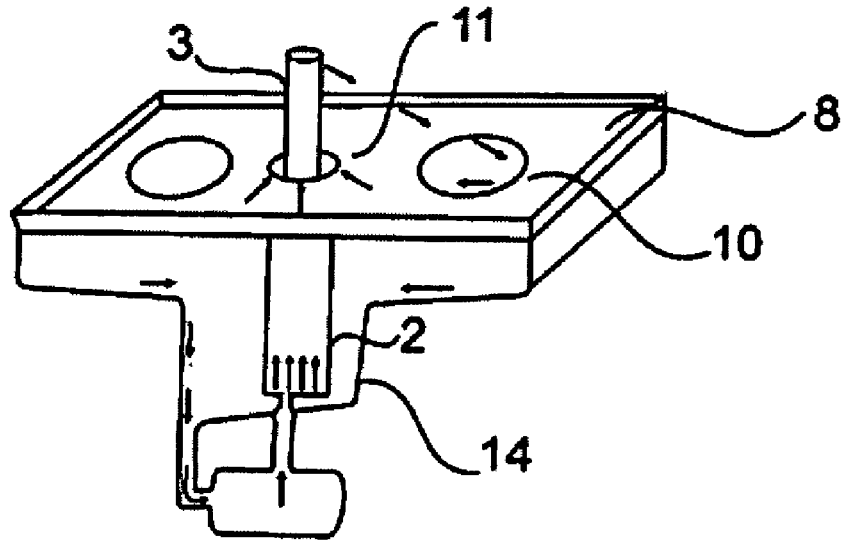
FIG. 3 illustrates a sectional view of the kitchen-range cooking top with the spraying tower in operation.

In FIG. 3 one can see the piston 3 out of its envelope 2, impelled by the force of the water or of any other cleaning element, above the cooking top 8 spraying the cleaning fluids over it and over its heating devices 10. In this embodiment of the invention, the cleaning fluids return to the reservoir 14 through the same opening 11 that the spraying tower has, without the need to pass through any conduit. In this opening 1, there may be a filter for retaining residues (not shown in FIG. 3).

Figure 4:
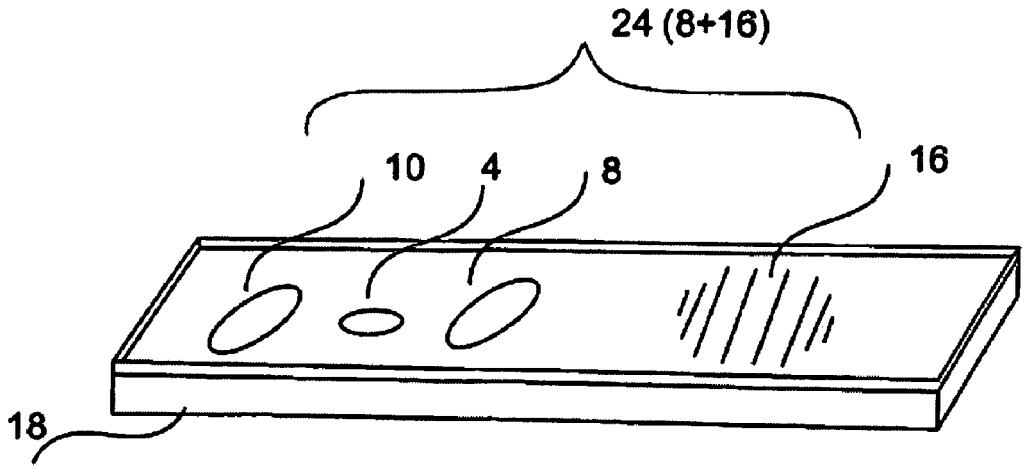
FIG. 4 illustrates a view of the cooking top with the work surface (extended top)

FIG. 4 shows the kitchen-range 18 with its cooking top 8 and its heating devices 10, the finish 4 of the spraying tower 5 embedded and the work area 16 of the extended top 24 (area 8 plus area 16). In this embodiment, one can have the spraying tower 5 acting on the area 8 of the cooking top and on the work surface 16, cleaning/washing both simultaneously.

Figure 5:
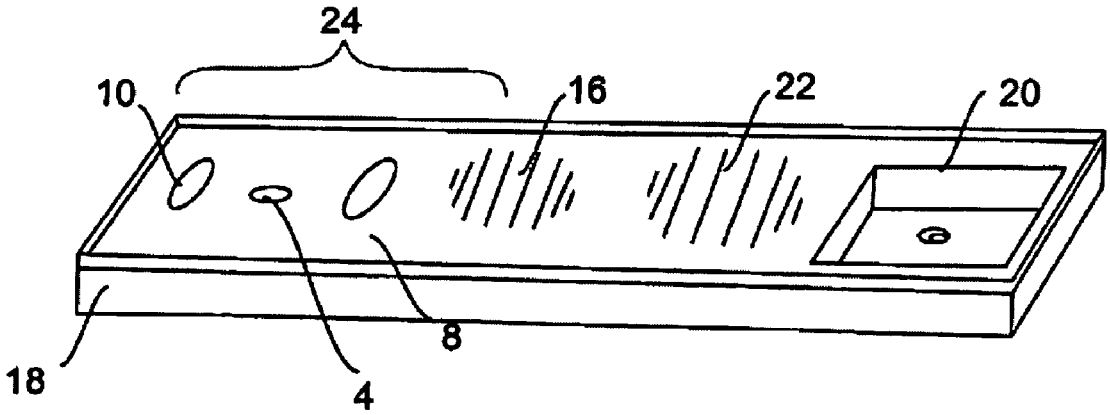
FIG. 5 illustrates a view of the kitchen-range cooking top with the self-cleaning assembly, with the work surface (extended top) integrated with a counter and sink.

FIG. 5 shows a kitchen-range 18 with an extended top 24 and a sink 20. Like the actuation of the self-cleaning system on the cooking top/surface 8 of the kitchen-range 18, one foresees the functioning of this cleaning/washing system when the kitchen-range 18 has accessories such as a counter, and a sink. The functioning takes place by the principle of jetting/spraying a cleaning-fluid solution through the spraying tower 5 over the cooking top 8, the counter 22 and the sink 20, and the tower 5 may be internally connected to the pumping system (or only to the cooking top 8 and to the counter 22, without the sink 20), a functioning equivalent to that of the self-cleaning assembly when there is only the cooking top 8 of the kitchen-range 18. It is important to point out that the self-cleaning assembly may be foreseen and incorporated into the kitchen-range 18 either in the manufacture state thereof or attached, mounted or engaged with the range subsequently.

In this embodiment, the self-cleaning assembly is illustrated with a spraying tower 5. The self-cleaning assembly may comprise more than one spraying tower, which may be arranged in different positions and locations. As in the case of the self-cleaning assembly for kitchen-range tops, one may also arrange a plurality of fixed and/or rotary sprayers of various sizes, propulsion components, control, valves, openings, conduits, reservoirs in a different number, in alternative locations and constituted by other materials without departing from the scope of the present invention.

Figure 6:
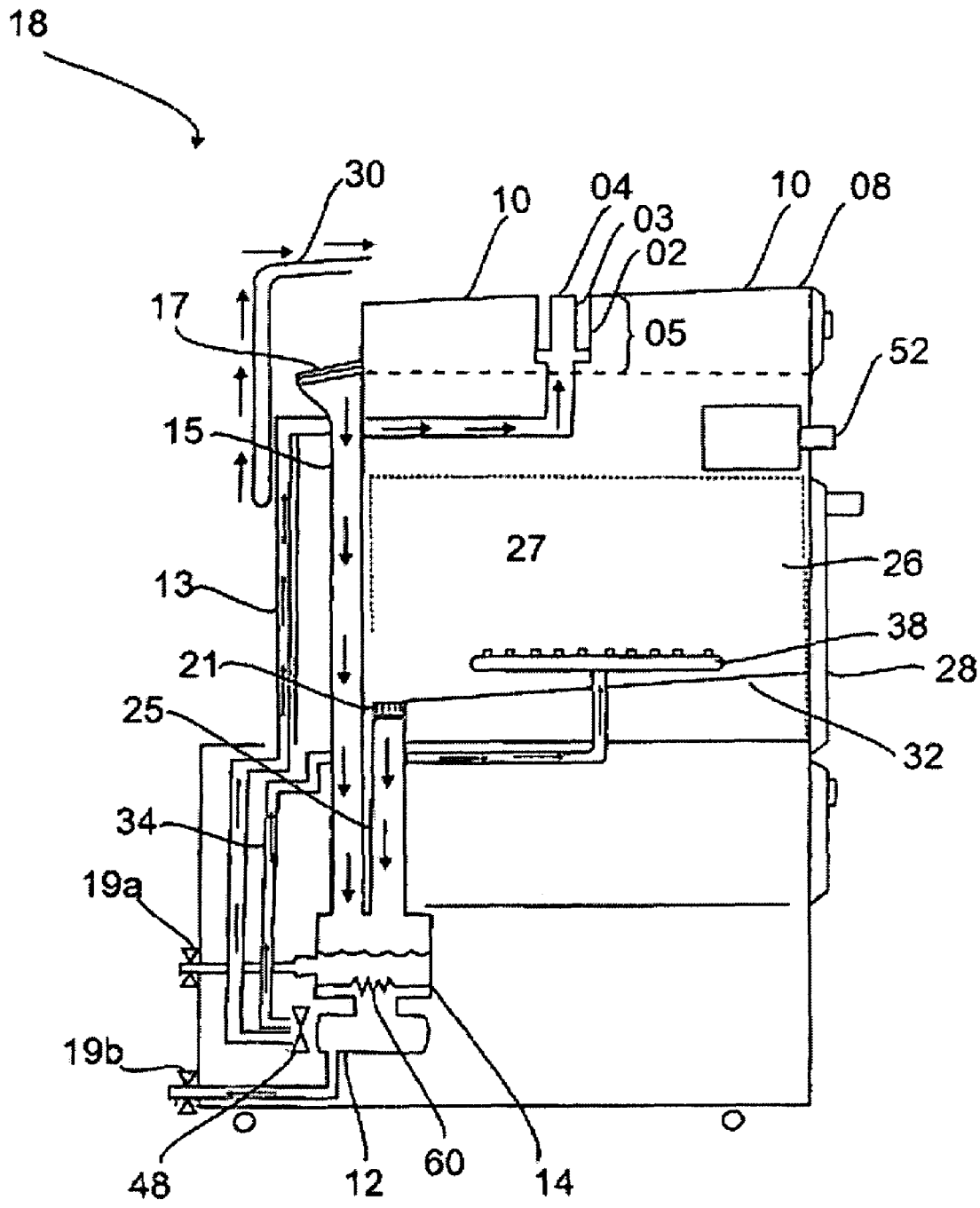
FIG. 6 illustrates a sectional view of an embodiment of the present invention, wherein the kitchen-range comprises a dish-washing machine.

FIG. 6 illustrates another embodiment of the present invention, wherein the self-cleaning assembly of the cooking top 8 of the kitchen-range 18 is integrated with a dish-washing machine 26. The dish-washing machine includes a second cleaning-element spraying assembly 38 arranged in the housing 27, which contains a base surface 32, inclined so as to allow the sprayed elements to flow to a portion where the outflow opening 21 is located. Additionally, there may be at least one second spraying assembly 38 (rotary spraying arm), provided within the dish-washing machine 26.

This figure further illustrates the existence of a third conduit 25, connecting the second outflow opening 21 to the propulsion means 12, and at least one fourth conduit 34 connecting the propulsion means to the second spraying assembly 38, so that the second opening 21, the third conduit 25, the propulsion means, the fourth conduit 34, the second spraying assembly 38 and the base surface 32 will form a cleaning-element circuit. Preferably, the second spraying assembly 38 is a rotary spraying arm provided within the dish-washing machine 26.

Generally, the propulsion means is a pump 12. In addition, the cleaning-element supplying valve 19A is connected to the inlet of the pump 12 through a reservoir 14.

In addition, if desirable, the first 17 and the second 21 outflow openings may include filters.

The control means 52 comprise at least one from an electronic circuit and a timer.

In the embodiment illustrated in FIG. 6, the re-feeding circuit comprises at least one first conduit 15 connecting the outflow opening 17 to propulsion means, and at least one second conduit 13 connecting the propulsion means to the retractable spraying tower 5.

An outflow conduit 25 connects the opening 21 of an inclined surface 32 of the housing 27 of the dish-washing machine to the pump 12, which in turn is connected to the second spraying assembly 38 through another conduit 34. Consequently, the outflow conduit 25, the pump 12, the second spraying conduit 34, the spraying system 38 and the inclined surface 32 form a cleaning-element circuit that can function in parallel with the first cleaning-element circuit (spraying tower 5, cooking top 8, first outflow conduit 15, reservoir 14, pump 12 and first spraying conduit 13). In other words, with the pump 12 in operation, the cleaning elements are impelled to circulate through these two circuits simultaneously or independently or to be drained by means of an external drainage means 19*b*. In order to obtain the independent functioning, one introduces in the above-described circuits a flow-directing device 48 (for example, a valve or valves), which will direct the cleaning elements to the dish-washing machine 26 through the conduit 34 and/or to the cooking top 8 of the kitchen-range 18 through the conduit 13.

The surface 32 of the dish-washing machine can serve as a cleaning-element reservoir, and in this case the reservoir 14 is suppressed.

By preference, the kitchen-range 18 further comprises an articulated sliding cover 30, which is used for closing, at least partly, the cooking top 8, while using the self-cleaning assembly/system.

Figure 7:
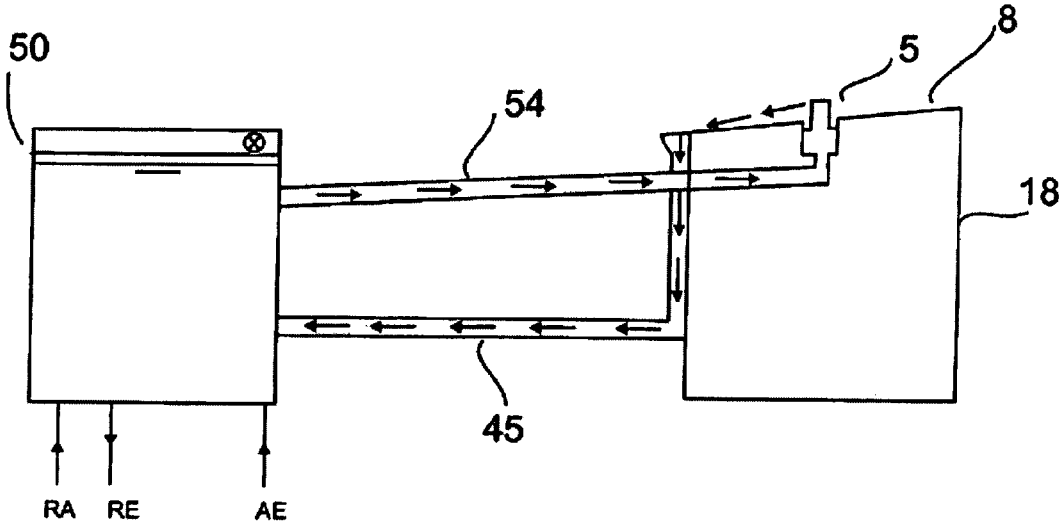
FIG. 7 illustrates a sectional view of an embodiment of the present invention, wherein the kitchen-range is integrated with a dish-washing machine.

FIG. 7 illustrates another embodiment of the present invention, in which the self-cleaning assembly for the range cooking top 8 is connected to an external dish-washing machine 50 through the spraying conduit 54. In this embodiment, one can observe that the self-cleaning system for the cooking top 8 of the kitchen-range 18 makes use of the mechanisms of the external dish-washing machine 50, not only to propel the cleaning elements (water in this embodiment), but also all the other commands and steps of the cleaning cycles. In order to route the water sprayed onto the cooking top 8 back to the dish-washing machine, the outflow conduit 45 is used. Consequently, one obtains a water circuit that is already propelled by the dish-washing machine 50, passing through the conduit 54, the cleaning tower 5, the cooking top 8, the outflow conduit 45 and returns to the dish-washing machine, where it will be propelled, heated and replaced, following the washing cycle of the dish-washing machine.

In this embodiment of the invention, one uses a dish-washing machine prepared for directing the water to an external conduit 54, receive it back from the conduit 45, beside the normal functions, inherent in this apparatus. In addition, in this embodiment the conduits are preferably polymeric hoses, although it should be clarified that other types of conduits and couplings may be used, without departing from the scope of the present invention.

The various embodiments of the invention may comprise different types of heating devices, among which electric stoves, be they with electric resistances, vitro-ceramic surface, electromagnetic induction and the most varied forms of generating heat with electric energy, or gas-outlet nozzles (gas stove). The top may be made of metal, polymer, ceramic, glass or the association of these materials. The support means may be any means on which cooking tops are rested. In the case of gas stoves, one resorts to metallic grids, in some electric stoves, in other cases vitro-ceramic surface and in still other cases the cooking top itself serves as a support means.

In addition, different covers for the kitchen-range may be employed, as long as they enable one to close the upper parts of the range partly. Such covers may be characterized as articulated covers, retractable covers or independent covers, which may be made from metal, ceramic, glass, polymer, or association of these materials. However, other materials may be used without departing from the scope of the present invention.

As described before, the kitchen-range of the present invention has a cleaning-element (cleaning fluids: liquids and vapors) spraying assembly, called retractable spraying tower, embedded in the cooking top, and at least one surface with an inclination, so that the elements sprayed can flow to a portion where a first outflow opening is arranged. This first opening may be the same opening through which the spraying tower rises above the level of the surface of the cooking top to spray the cleaning elements.

Preferably, one uses water as a cleaning medium. The retractable spraying tower 5 is kept housed below the cooking top 8, where it does not interfere with the withdrawal of the cooking pots and other utensils used in cooking food, beside not interfering much with the esthetic of the kitchen-range 18. During the use of the self-cleaning assembly, this tower 5 rises above the level of the cooking top 8, thus enabling the spraying of the cleaning elements over the surfaces of the cooking top 8 and cover 30 of the range 18. Once the assembly has been actuated, the force of the water or other medium having mechanical action impels the tower 5 (at least one tower) up above the cooking top 8, so that the cleaning elements can be jetted over the top 8 and towards the cover 30 (if any). When the system stops, the retractable spraying tower 4 returns to its original housing.

In this way, one solves the problem of the sprayers interfering with the placing and withdrawal of the cooking pots and other utensils used in cooking food, adding esthetical qualities to said cooking top. During the operation cycle of the self-cleaning assembly, the rising and falling of the spraying tower 5 may take place several times, so that the various steps of the washing cycles can be completed.

At the end of the process, the retractable spraying tower 5 retracts and remains in its embedded housing 14. The present invention also provides a surface (work area) for preparing food contiguous to/adjacent the cooking top 8, called extended top, which also makes use of the benefits of the self-cleaning assembly. This extended top is nothing else than a cooking top 8 of the kitchen-range with an extra space, intended for preparing food.

Generally, when foods are prepared, it is necessary to cut, peel, mix, homogenize, etc. them. It is natural that, during the performance of these tasks, food residues fall and sprinkle over the surfaces where they are been handled. In order to save the task of cleaning these surfaces where foods are prepared, one has decided to create at least one surface attached to the range top for the purpose of preparing these foods, with the advantage of being able to wash it by the same process as the range top, by using the self-cleaning assembly of the range according to the invention. There are kitchen-ranges where we can find the following pieces integrated with the cooking top: counters, sinks, workbenches and a number of integrated/contiguous surfaces.

In view of the foregoing, the present invention aims at providing a self-cleaning assembly for a kitchen-range, which can also actuate on these surfaces, in order to minimize the work of cleaning them. By using the same mechanism that exists in the self-cleaning assembly of the kitchen-range and expanding its use to these surfaces too, it is feasible to clean them. This embodiment embraces kitchen-ranges with a self-cleaning assembly that area already provided with these surfaces and can receive these surfaces; that is to say, both whether the range with a self-cleaning assembly already has the above-mentioned surfaces fixed to its body at the manufacturing state or if they are attached thereto subsequently, one foresees the use of the self-cleaning assembly on them. One also foresees that it should be possible to purchase the kitchen-range and the other surfaces at different moments and to "join them" (assemble them) in order to obtain a unity of this kitchen-range with a self-cleaning assembly cable of cleaning the cooking table and the other surfaces.

In order to provide alternating cleaning cycles, one introduces herein the concept of spraying vapors onto the kitchen-range surfaces and continuous surfaces. By using the mechanisms and techniques already presented in Brazil Patent Application P10304574-9, the disclosure of which is incorporated in its entirety herein by reference, one produces cleaning vapors for actuation together with the already-presented cleaning cycles, or cycles that are based only on the use of vapors and of their sanitizing properties in order to clean the surfaces.

One could use suction by negative pressure (effected by the pump) applied to the surfaces to be cleaned in order to aid in the conventional cycles already cited in patent application P10304574-9. One could also use this suction mechanism to effect alternating cleaning cycles, so that the elements deposited on the surfaces to be cleaned could be displaced therefrom, this providing sanitation.

Ultrasound waves may also be used, either associated or not with the other described techniques. In order to have the benefit of using such an aid, it is necessary to introduce an ultrasound generator for acting on the surfaces to be cleaned.

On the other hand, the use of supercritical fluids involves a technology different from that presented in patent application P10304574-9. Among the known supercritical fluids, one uses $CO_2$ due to the ease of obtaining this raw material and the temperature where this gas has a supercritical fluid behavior. New components should be introduced for use of this technology (already known from the prior art): fluid storing tanks (which, in general, is in the liquid phase), conduits for supplying and discharging the fluid, control valve, hermetic cover for the surfaces to be cleaned, which will receive the fluid, heat exchangers, temperature sensors, pressure controllers, pumps, pressure sensors, collecting devices, filters, mechanical stirring devices, and even ultrasound generating devices. In order to perform the cleaning, one can opt for a number of variations of processes. The basic process would be to fill the housing that contains the kitchen-range surfaces and the integrated surfaces to be cleaned with the supercritical fluid, saturating it, allowing the fluid to act, stirring, circulating the fluid, rinsing, repeating the process, decompressing, disposing or reusing the fluid.

There are a number of embodiments for the cleaning processes using supercritical fluids. An example is the one described hereinafter: one introduces $CO_2$ in the housing to be cleaned through a conduit and a valve that connects the storage tank to the housing. $CO_2$ is introduced until the desired level is reached, or the housing pressure is raised through a $CO_2$ injecting pump. One may also use a procedure that dispenses with the use of the pump, that is to say, one introduces, for example, $N_2$ (an inexpensive inert gas), which has a storage pressure higher than that of $CO_2$ and, therefore, it would be responsible for the increase in pressure in the chamber. In this way, the $CO_2$ contained in the chamber would reach the supercritical fluid pressure. One may adjust the temperature and the pressure in this step in order to keep them within the desired parameters of supercritical fluid. With at least one fluid in the supercritical phase, one may add surfactants, co-solvents and other additives to aid in the cleaning process. Some parameters may be manipulated for achieving better results. Such parameters are: the time during which the supercritical fluid will remain in the housing to be cleaned, mechanical stirring, application of ultrasound, circulation of the fluid in the housing, or simply saturation and rest. In the case of circulation, the rise in temperature can be dealt with by using heat exchangers or by introducing more liquefied super-cooled gas. Upon opening the valve for decompression of the housing, one may release the supercritical fluid to the environment, which passes through the collection device (filter) for retention of the removed materials or destine the recovery $CO_2$ for re-use, making use of principles such as condensation, distillation, among others. The process of bathing with the supercritical fluid and decompression may be repeated as many times as necessary to achieve the expected results of cleaning (with or without additives). This bath, which in this example occurred with supercritical $CO_2$ may also be carried out with gas $CO_2$, supercritical fluid plus co-solvent, surfactants, liquid $CO_2$, $CO_2$ plus surfactant, among other options. The drying of the surfaces is effected during the decompression process, when the $CO_2$ returns to the gas state.

In order to deal with odors generated by the cooking of foods, one has foreseen an environment self-cleaning system. Such a system participates in the intrinsic operation of the kitchen-range. Upon heating the cleaning elements/fluids (preferably water plus detergent) there is a portion that vaporizes during the process. These cleaning elements that vaporize have the property of masking/overlapping undesirable odors from the cooking of foods. This process occurs due to the fact that the detergents have essences contained in their formulation, which disperse over the environment by diffusion. In addition to the essences inherent in the detergents, one also foresees the use of alternative essences and/or cleaning elements to be added.

Preferred embodiments having been described, it should be understood that the scope of the present invention embraces other possible variations, being limited only by the contents of the accompanying claims, which include the possible equivalents.

What is claimed is:

1. A kitchen-range (18) of the type having a cooking top (8) comprising a surface on which at least one heating device (10) is arranged and on which a support means is arranged; the kitchen-range comprising:

a first cleaning-element spraying assembly comprising at least one retractable spraying tower (5), housed in the cooking top (8), the retractable spraying tower comprising a piston (3) having spray orifices, said surface of the cooking top (8) having an opening (11) that allows said piston (3) to move upwards to a raised position elevationally above the surface and downwards to a position wherein a top of said piston is positioned level with or elevationally lower than the surface, said surface being inclined with respect to the horizontal plane, so that the elements sprayed by the retractable spraying tower (5) can flow to an outflow opening (17) connected to a circuit (12, 13, 15) that feeds cleaning elements back to said spraying assembly;

a cleaning elements supply structure coupled with said circuit for connecting said circuit to an external source of cleaning elements, a cleaning elements drain structure coupled to the circuit for connecting the circuit to an external drain, and control structure for opening and closing the cleaning elements supply structure and the cleaning elements drain structure, enabling the entry and exit of the cleaning elements into and out of the circuit, and for turning on and off said cleaning elements supplying structure and the cleaning elements drain structure; and initiating and finishing the circulation of the cleaning elements through the circuit.

2. A kitchen-range (18) according to claim 1, wherein said circuit comprises at least one first conduit (15) connecting the outflow opening (17) to a propulsion means (12), and at least a second conduit (13) connecting the propulsion means to the retractable spraying tower (5).

3. A kitchen-range (18) according to claim 2, further comprising a dish-washing machine (26) of the type that includes a housing (27) for accommodating dishes and a cover (28) for covering said dishe-washing machine, the dish-washing machine (26) comprising:

a second cleaning elements spraying assembly arranged in the housing (27), a base surface (32) of the latter being inclined, so that the spraying elements can flow to a portion where a second outflow opening (21) is arranged;

at least one third conduit (25) connecting the second outflow opening (21) to the propulsion means (12), and at least one fourth conduit (34) connecting the propulsion means (12) to the second spraying assembly (38), so that the second opening (21), the third conduit (25), the propulsion means, the fourth conduit (34), the second spraying assembly (38) and the base surface (32) will form a cleaning elements circuit.

4. A kitchen-range (18) according to claim 1, wherein the cleaning elements are fluids.

5. A kitchen-range (18) according to claim 2, wherein the propulsion means is a pump (12).

6. A kitchen-range (18) according to claim 5, wherein the cleaning elements supply structure is further includes a valve (19*a*) for controlling a flow of cleaning elements to said circuit.

7. A kitchen-range (18) according to claim 6, wherein the circuit comprises a cleaning elements heating means (60).

8. A kitchen-range (18) according to claim 3, wherein a spraying means of the second spraying assembly includes at least one spraying arm (38).

9. A kitchen-range (18) according to claim 3, wherein the first (17) and the second (21) outflow openings include filters.

10. A kitchen-range (18) according to claim 1, wherein the control means (52) comprises an electronic circuit.

11. A kitchen-range (18) according to claim 1, wherein the control means (52) comprises a timer.

12. A kitchen-range (18) according to claim 1, wherein the cleaning elements are supercritical fluids.

13. A kitchen-range (18) according to claim 1, comprising a cover (30) for closing, at least partly, the cooking top.

14. A kitchen-range (18) according to claim 1, further comprising an extended top positioned proximate the cooking top (8).

15. A kitchen-range (18) according to claim 1, wherein the cleaning elements include at least one deodorant.

16. A kitchen-range (18) according to claim 15, wherein the deodorant is a detergent.

17. A self-cleaning assembly couplable to a surface of a cooking top (8) of a kitchen-range (18), said self-cleaning assembly comprising:

at least one first conduit capable of connecting an outflow opening in a surface of the cooking top to a propulsion means, and at least one second conduit capable of connecting the propulsion means to a cleaning-element spraying assembly comprising at least one retractable spraying tower (5) to be attached to said cooking top, said retractable spraying tower comprising a piston (3) having orifices, so that the outflow opening, the first conduit, the propulsion means, the second conduit, and the spraying assembly together form a cleaning circuit;

a cleaning elements supply structure for connecting an external source of cleaning elements to said cleaning circuit;

a cleaning elements drain structure for connecting the circuit to an external drain;

wherein, upon an actuation of the spraying assembly, the piston (3) is movable from a position wherein a top thereof is level with or lower than the surface of the cooking top to a position elevationally above the surface of the cooking top.

18. A self-cleaning assembly couplable to a surface of an extended top (24) having a work area (16) and an embedded cooking top (18), said self-cleaning assembly comprising:

at least one first conduit capable of connecting an outflow opening in said surface of the extended top to propulsion means, and at least one second conduit capable of connecting the propulsion means to a cleaning elements spraying assembly comprising at least one retractable spraying tower (5) to be attached to said surface, said retractable spraying tower (5) comprising a piston (3) having orifices, so that the opening, the first conduit, the propulsion means, the second conduit, and the spraying assembly form a cleaning circuit; and a cleaning elements supply structure for connecting an external source of cleaning elements to said cleaning circuit, and a cleaning drain structure for connecting the cleaning circuit to an external drain wherein the extended top (24) is a kitchen counter top, and wherein upon an actuation of the self-cleaning assembly, the piston (3) is movable from a position wherein a top thereof is positioned level with or lower than the surface of the extended top to a position elevationally above the surface of the extended top.

19. A self-cleaning assembly couplable to a surface of an extended top (24), according to claim 18, wherein the extended top, further includes a structure selected from the group consisting of a sink, a workbench, and a top.

20. A kitchen-range (18) of the type that has a cooking top (8) comprising a surface on which at least one heating device (10) is arranged and on which a support means is arranged, the kitchen-range comprising:

a first cleaning-element spraying assembly comprising at least a retractable spraying tower (5) housed in the cooking top (8), the retractable spraying tower comprising a piston (3) having orifices, said surface of the cooking top having an opening (11) that allows said piston (3) to move upwards to a raised position with respect to the surface and downwards to a position wherein a top thereof is level with or lower than the surface, said surface being slightly inclined downwards with respect to the horizontal plane in the direction of the opening (11), so that the elements sprayed by the retractable spraying tower (5) can flow through said opening (11), said opening (11) being connected to a cleaning-element reservoir (14);

cleaning elements propelling means (12) connected to said reservoir (14) and to said retractable spraying tower (5), so that said opening (11), the retractable spraying tower (5), the reservoir (14) and the cleaning-element propelling means (12) form a cleaning circuit; and control means for turning on and off the functioning of the propelling means (12), enabling the circulation of cleaning elements through the circuit.

21. An extended top comprising a work area (16) and an embedded cooking top (18), said cooking top comprising a surface on which at least one heating device (10) is arranged and on which a support means is arranged; said extended top further comprising:

a cleaning elements spraying assembly comprising at least one retractable spraying tower (5) housed in the cooking top (18), the retractable tower comprising a piston (3) having orifices, said surface of the cooking top having an opening (11) that allows said piston (3) to move upwards to a raised position elevationally above the surface and downwards to a position wherein a top thereof is level with or lower than the surface, the spray tower (5) being provided close to the work area (16) so that cleaning element may be sprayed over said area (16), said surface being inclined with respect to the horizontal plane, so that the elements sprayed by the retractable spraying tower (5) can flow to an outflow opening connected to a circuit that re-feeds cleaning elements back to said spraying assembly;

a cleaning elements supply structure for connecting an external source of cleaning elements to said circuit, said cleaning elements supply structure including a valve (19*a*); and a cleaning elements drain structure for connecting the circuit to an external drain, said cleaning elements drain structure including a valve (19*b*); and a control device for opening and closing said supply and drain structures, enabling the entry and exit of cleaning-elements into and out of the circuit, and for turning on and off said supply and drain structures initiating and finishing the circulation of cleaning elements through the circuit.

22. An extended top (24) according to claim 21, further comprising a kitchen sink (20).

23. A kitchen-range (18) of the type that has a cooking top (8) having a surface on which at least one heating device (10) is arranged and on which a support means is arranged; the kitchen-range comprising:

a first cleaning-element spraying assembly comprising at least one retractable spraying tower (5) housed in the cooking top (8), the retractable spraying tower (5) comprising a piston (3) including orifices, said surface of the cooking top having an opening (11) that allows said piston (3) to move upwards to a raised position elevationally above the surface and downwards to a position wherein a top thereof is level with or lower than the surface, said surface being inclined with respect to the horizontal plane, so that the elements sprayed by the retractable spraying tower (5) can flow to an outflow opening connected to a re-feeding circuit (45, 54) that feeds cleaning elements back to said spraying assembly;

said re-feeding circuit (45, 54) being part of a hydraulic system of a dish-washing machine comprising a tubing connected to the water-supply network another tubing connected to a sewer system.

24. The kitchen-range of claim 1 wherein said cleaning elements supply structure is configured such that upon an opening of said cleaning elements supply structure, said spraying tower is forcedly driven upwards to said raised position by the cleaning elements within said circuit.

* * * * *